US008028487B2

(12) United States Patent
Engstrom

(10) Patent No.: US 8,028,487 B2
(45) Date of Patent: Oct. 4, 2011

(54) COLLAPSIBLE STUD WALL, METAL, LOAD BEARING AND NON-LOAD BEARING

(76) Inventor: George Edward Engstrom, Fresno, CA (US)

( * ) Notice: Subject to any disclaimer, the term of this patent is extended or adjusted under 35 U.S.C. 154(b) by 0 days.

(21) Appl. No.: 10/441,412

(22) Filed: May 20, 2003

(65) Prior Publication Data

US 2004/0231274 A1 Nov. 25, 2004

(51) Int. Cl.

| | |
|---|---|
| ***E04H 12/18*** | (2006.01) |
| ***E04C 3/02*** | (2006.01) |
| ***E04B 1/344*** | (2006.01) |
| ***F16B 7/18*** | (2006.01) |
| *E04H 12/06* | (2006.01) |
| *E04H 12/10* | (2006.01) |

(52) U.S. Cl. ..... 52/645; 52/126.6; 52/481.2; 52/656.1; 52/690; 52/745.11; 52/745.14

(58) Field of Classification Search ..... 52/645, 52/126.6, 481.2, 656.1, 690, 745.11, 745.14, 52/745.13, 481.1, 301, 290, 238.1, 241–243, 52/630, 664, 633, 573, 573.1; 403/116
See application file for complete search history.

(56) References Cited

U.S. PATENT DOCUMENTS

| | | | | |
|---|---|---|---|---|
| 1,503,391 | A * | 7/1924 | Teske | 5/119 |
| 1,777,028 | A * | 9/1930 | Berbeck | 135/160 |
| 2,058,386 | A * | 10/1936 | Parsons | 52/290 |
| 2,236,774 | A * | 4/1941 | Hill | 52/632 |
| 2,350,255 | A * | 5/1944 | Shippee et al. | 411/554 |
| 2,595,288 | A * | 5/1952 | Peters | 30/512 |
| 2,638,300 | A * | 5/1953 | De Jen | 248/464 |
| 2,835,262 | A * | 5/1958 | Collins | 135/121 |
| 2,957,539 | A * | 10/1960 | Padlo | 182/94 |
| 3,001,615 | A * | 9/1961 | Ries | 403/230 |
| 3,008,550 | A * | 11/1961 | Miles et al. | 52/210 |
| 3,241,684 | A * | 3/1966 | Willsey | 211/105.1 |
| 4,004,778 | A * | 1/1977 | Steinhagen | 212/294 |
| 4,802,501 | A * | 2/1989 | Hall, II | 135/143 |
| 5,050,353 | A * | 9/1991 | Rogers et al. | 52/8 |
| 5,127,760 | A * | 7/1992 | Brady | 403/230 |
| 5,209,030 | A * | 5/1993 | Sloditskie et al. | 52/79.5 |
| 5,222,335 | A | 6/1993 | Petrecca | |
| 5,313,752 | A * | 5/1994 | Hatzinikolas | 52/243 |
| 5,653,349 | A * | 8/1997 | Dana et al. | 211/189 |
| 5,685,121 | A * | 11/1997 | DeFrancesco et al. | 52/731.9 |
| 5,729,950 | A | 3/1998 | Hardy | |
| 5,735,100 | A | 4/1998 | Campbell | |
| 5,906,080 | A * | 5/1999 | diGirolamo et al. | 52/243.1 |
| 6,088,982 | A * | 7/2000 | Hiesberger | 52/241 |
| 6,176,053 | B1 * | 1/2001 | St. Germain | 52/232 |
| 6,299,009 | B1 * | 10/2001 | Ryziuk et al. | 220/1.5 |
| 6,318,044 | B1 | 11/2001 | Campbell | |
| 6,401,422 | B1 * | 6/2002 | Olden | 52/645 |
| 6,666,223 | B2 * | 12/2003 | Price et al. | 135/131 |
| 6,772,780 | B2 * | 8/2004 | Price | 135/131 |
| 6,854,237 | B2 * | 2/2005 | Surowiecki | 52/633 |
| 2003/0074849 | A1 * | 4/2003 | Surowiecki | 52/301 |

* cited by examiner

*Primary Examiner* — Jeanette E. Chapman
(74) *Attorney, Agent, or Firm* — Carr & Ferrell LLP

(57) ABSTRACT

Load bearing and non-load bearing frames for walls, roofs and floors are prefabricated according to a predetermined building plan and made to disengage and collapse to a compact and intact frame, where, as with a wall frame, studs are resting against one another and the upper and lower tracks are in close approximation to each other, separated only by said resting studs. Said frames for walls, roofs and floors can be readily be transported to a construction site, where the collapsed frames are expanded, engaged, stabilized and permanently plumbed and braced.

13 Claims, 6 Drawing Sheets

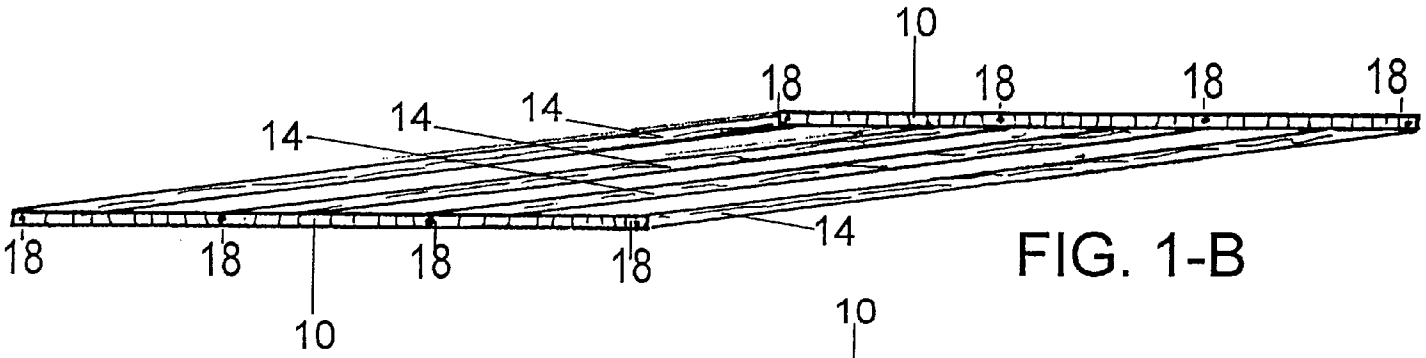
FIG. 1-B
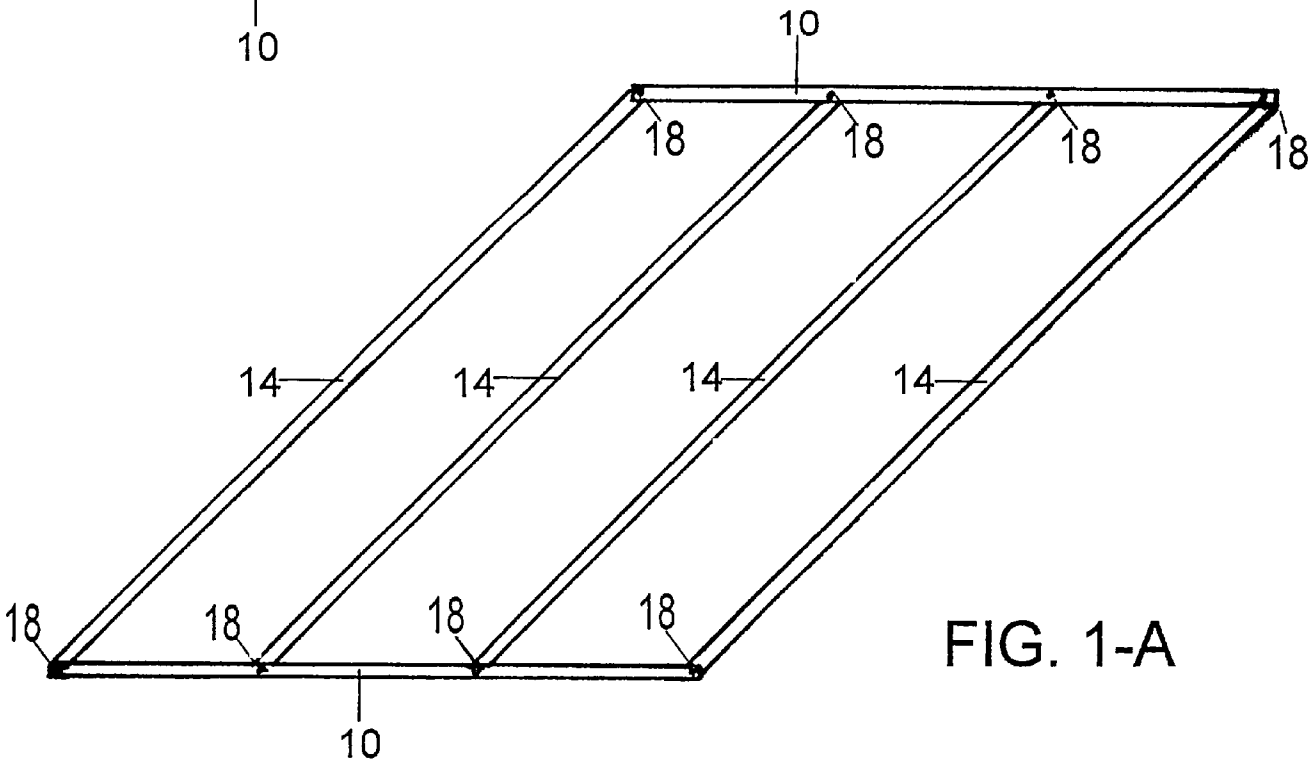
FIG. 1-A

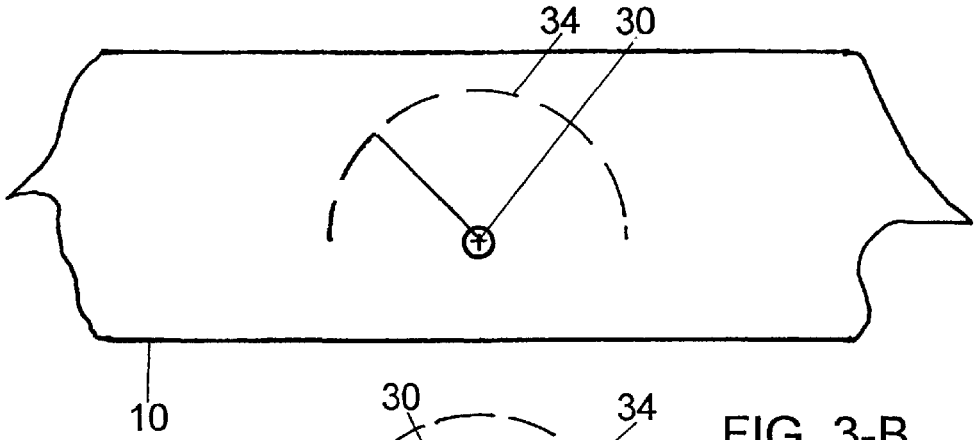
FIG. 3-B
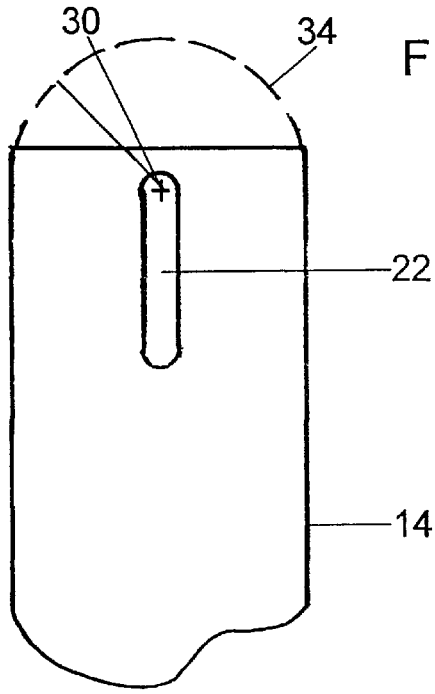
FIG. 3-A

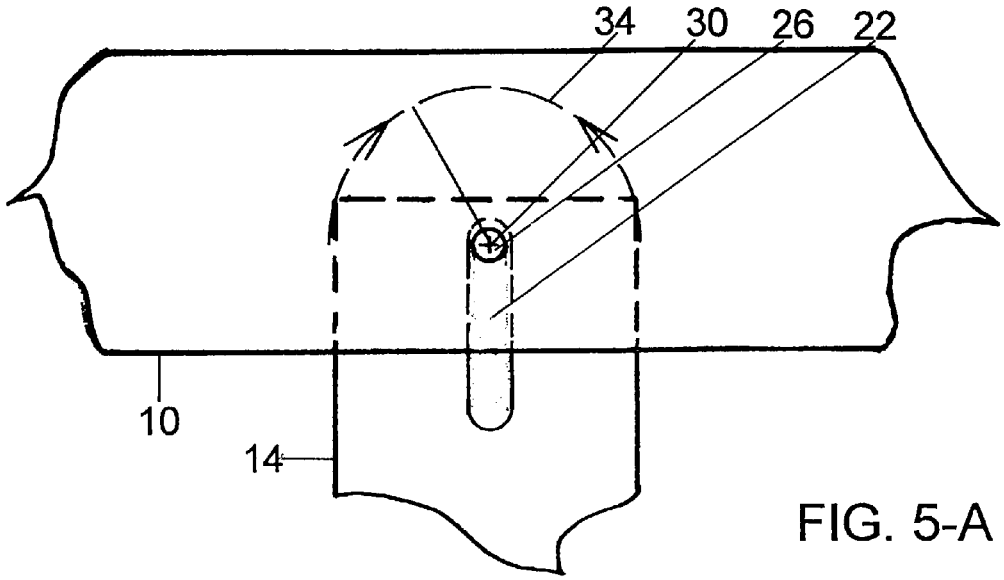
FIG. 5-A
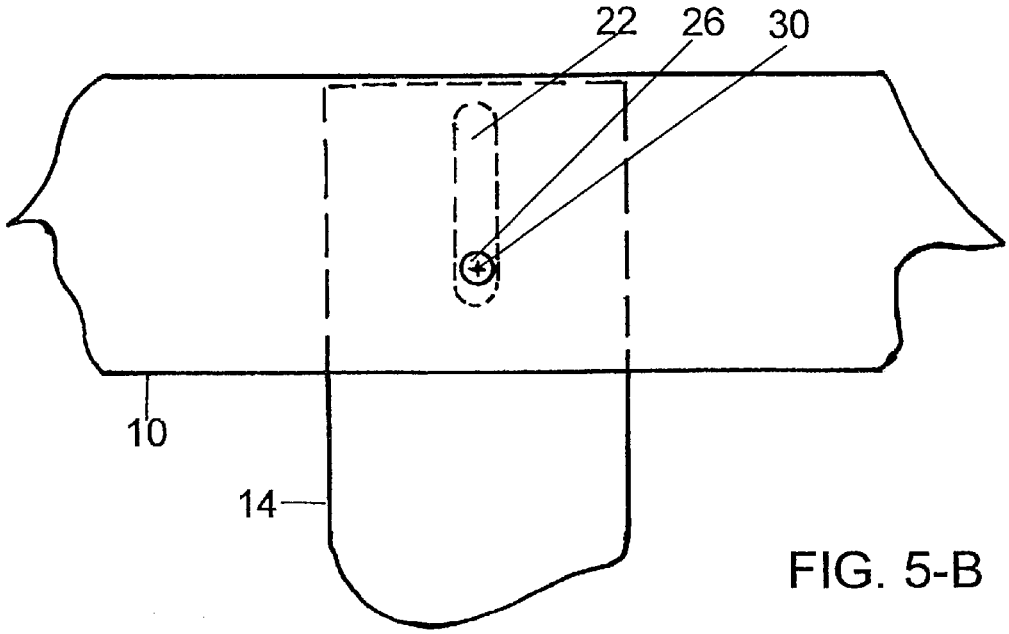
FIG. 5-B

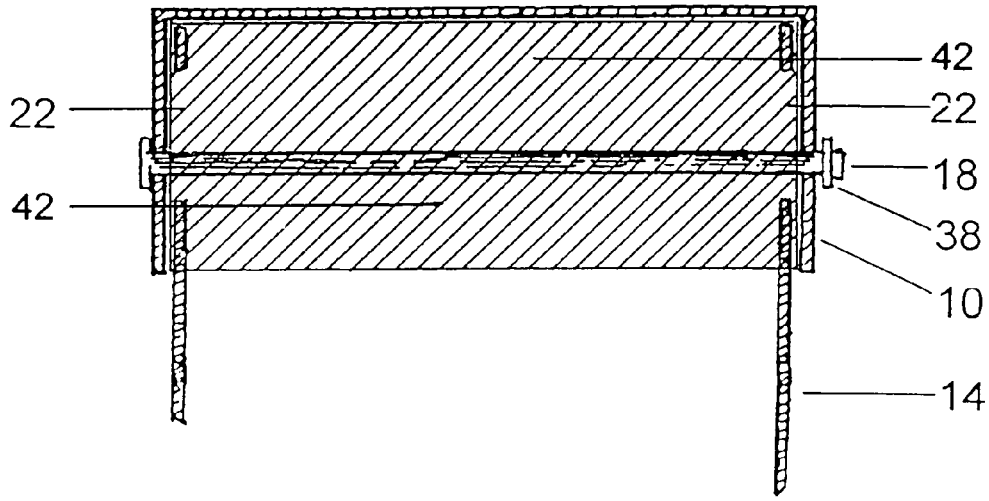
FIG. 6-A
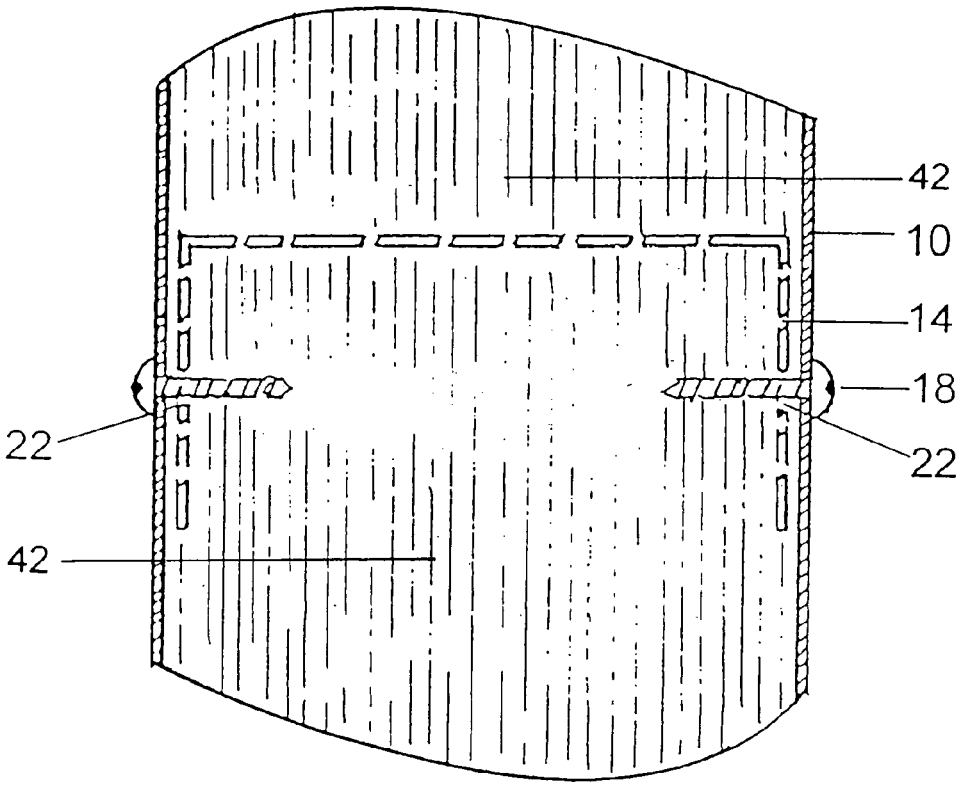
FIG. 6-B

COLLAPSIBLE STUD WALL, METAL, LOAD BEARING AND NON-LOAD BEARING

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

1. Field of Invention

This invention relates to prefabricated metal frames for walls, floors and roofs that can be readily disengaged and collapsed into a compact and intact frame for transport to the building site where the collapsed frames can be expanded, engaged, stabilized and permanently plumbed and braced as an integral part of a permanent structure.

2. Discussion of Prior Art

Prefabricating portions, or all, of structures has long been recognized as a means of speeding erection and providing uniformity of construction. The advent of light gauge steel building components offer new prefabrication potential. Several patents have been issued addressing offsite fabrication ranging from entire structures to individual snap-together components.

U.S. Pat. No. 6,318,044 B1 issued to Campbell (2001) offers a prefabricated structure. Specially formed components are required to erect a structure, thereby increasing cost and reducing onsite flexibility. The patent offers a system for framing a complete building which must be accepted by the user as offered or a different structure must be engineered and fabricated at additional cost.

U.S. Pat. No. 5,735,100 issued to Campbell (1998) offers Folding Telescopic Prefabricated Framing Units for Non-Load Bearing Walls. The walls fold by beveling each stud which enables the stud to pivot against the upper and lower tracks. While these units fold, or collapse, there is no load bearing capacity.

U.S. Pat. No. 5,729,950 issued to Hardy (1998) involves a reinforcing brace frame which is intended to be inserted within a stud wall to offer shear capacity. It is not meant to be a complete framed wall. Rather it is meant to be placed within a framed wall to offer strength.

U.S. Pat. No. 5,222,335 issued to Petrecca (1993) offers studs which are dimpled to snap into a receiving track or spaced flaps which allow studs to be snapped into a predetermined position. Stud and track must be fabricated to afford this capability. Such fabrication is not common in the industry and does not lend itself to offsite prefabrication because members could fall apart in transit.

SUMMARY

In accordance with the present invention, load bearing and non-load bearing frames for walls, roofs and floors are prefabricated according to a predetermined building plan and constructed to collapse from an engaged frame to a disengaged, compact and intact frame, where, as with a wall frame, studs are resting against one another and the upper and lower tracks are in close approximation to each other, separated only by said resting studs. Said frames for walls, roofs and floors can be readily transported to a construction site, where the collapsed frames can be expanded, engaged, stabilized and permanently plumbed and braced.

Although the descriptions, drawings and claims herein reference the present invention in terms readily applicable to the context of frames for walls, such as exemplified by use of the terms "stud" and "track," it readily will be appreciated by one of ordinary skill in the art that such terms refer to a vertical member and a horizontal member, respectively, and that the present invention is equally and readily applicable to frames for roofs and floors. The present invention may be used with materials other than metal that are adapted to perform a function commensurate with metal. Finally, although the descriptions, drawings and claims herein reference frame prefabrication, it should be understood that said term applies equally to the process of frame fabrication.

OBJECTS AND ADVANTAGES

Accordingly, in addition to the objects and advantages described above, several objects and advantages of the present invention are:

(a) Readily available formed metal members can be used in part to fabricate wall, floor or roof frames. Expensive custom metal forming is not necessary.

(b) The frames for walls, floors or roofs collapse into compact and intact frames, which conserve transport space and are highly unlikely to fall apart in transit.

(c) The collapsed frames can be quickly expanded, engaged, stabilized and permanently plumbed and braced by an unskilled worker.

(d) Since it is necessary only to expand, engage and stabilize the wall, floor or roof frames, framing errors are avoided.

(e) The means of prefabricating wall, floor and roof frames described herein allows onsite incorporation of changes after the frames are expanded and engaged at the building site because readily available components can be incorporated into the frame.

(f) Time is saved. Onsite calculations are not necessary to frame a structure.

(g) Waste is reduced because wall, floor and/or roof frames are prefabricated. Pilferage is reduced because frames arrive onsite as an intact frame rather than single pieces.

(h) This collapsible framing system allows anyone with rudimentary tool skills to expand, engage, stabilize and permanently plumb and brace a structure.

DRAWING FIGURES

FIG. 1-A shows a collapsible metal frame, in this instance a wall frame, disengaged and partially collapsed.

FIG. 1-B shows a disengaged, collapsed frame.

FIG. 2 shows a perspective of a wall frame, expanded and engaged.

FIG. 3-A shows the side view of a stud with elongated perforation and the dotted line illustrates its arc when disengaged and made collapsible.

FIG. 3-B shows a track which receives stud with pivot point and arc defined.

FIG. 4 shows stud in track rotating around pivot point.

FIG. 5-A shows stud disengaged from top of track with pivot point at top of elongated perforation and in position to pivot in either direction in order to collapse.

FIG. 5-B shows stud flush against interior of track channel with pivot point at bottom of elongated perforation.

FIG. 6-A shows side view of track with stud positioned flush against track channel and attached with connector through elongated perforation. Track channel is indicated by diagonal lines.

FIG. 6-B shows top view of track channel with stud positioned and connected. Track channel is indicated by vertical lines.

REFERENCE NUMERALS IN DRAWINGS

10 Track
14 Stud
18 Connector
22 Elongated perforation
26 Hole in track
30 Pivot point
34 Arc around pivot point
38 Retainer ring
42 Track channel

BRIEF DESCRIPTION OF DRAWINGS

FIG. 1A shows a prefabricated, collapsible metal frame, in this instance a wall frame, disengaged and partially collapsed. This frame employs studs, 14, and tracks, 10, attached to one another by connectors, 18, to form the frame for a wall. Wall, roof and floor frames may vary in height, length and width and are constructed, for example, in the case of a wall frame, using various thicknesses and shapes of studs and tracks in order to accommodate a predetermined building plan.

FIG. 1-B shows a disengaged and collapsed wall frame, ready to be expanded, engaged, stabilized and permanently plumbed and braced at the building site.

FIG. 3-A and FIG. 3-B illustrate the feature which allows the claimed wall, roof and/or floor frames to function. An elongated perforation, 22, appropriately placed near the end of stud, 14, allows the stud to pivot within track, 10, around pivot point, 30, and arc, 34. FIG. 3-B shows track, 10, with arc, 34, around pivot point, 30. This arc occurs when connector, 18, is at the uppermost point of the elongated perforation, 22, in stud, 14. When stud, 14, is inserted to maximum depth in track, 10, with connectors at lowest point of elongated perforation, 22, top of stud, 14, is flush and firmly against the interior of track channel, 42.

FIG. 5-B illustrates stud, 14, fully extended into track channel, 42, with hole, 26, in track flange, at bottom of elongated perforation, 22.

FIG. 5-A illustrates stud, 14, with pivot point, 30, at top of elongated perforation, 22, to allow stud, 14, to disengage and pivot in track channel, 42, around arc, 34, thereby allowing collapse of frame.

FIG. 6-B illustrates top view track, 10, with stud, 14, in dotted line relief. Connector, 18, attaches firmly to flange of track, 10, but allows stud, 14, to slide along the length of elongated perforation, 22, since elongated perforation, 22, is slightly larger than the diameter of the connector, 18. Track channel, 42, is indicated by vertical lines.

FIG. 6-A illustrates cross section track, 10, with stud, 14, fully inserted into track channel, 42, with pivot near bottom of elongated perforation, 22. Stud, 14, is held in place in track, 10, by connector, 18, shown in FIG. 5A. Retainer ring, 38, holds connector, 18, in place. Track channel, 42, is indicated by diagonal lines.

OPERATION

Figure 2:
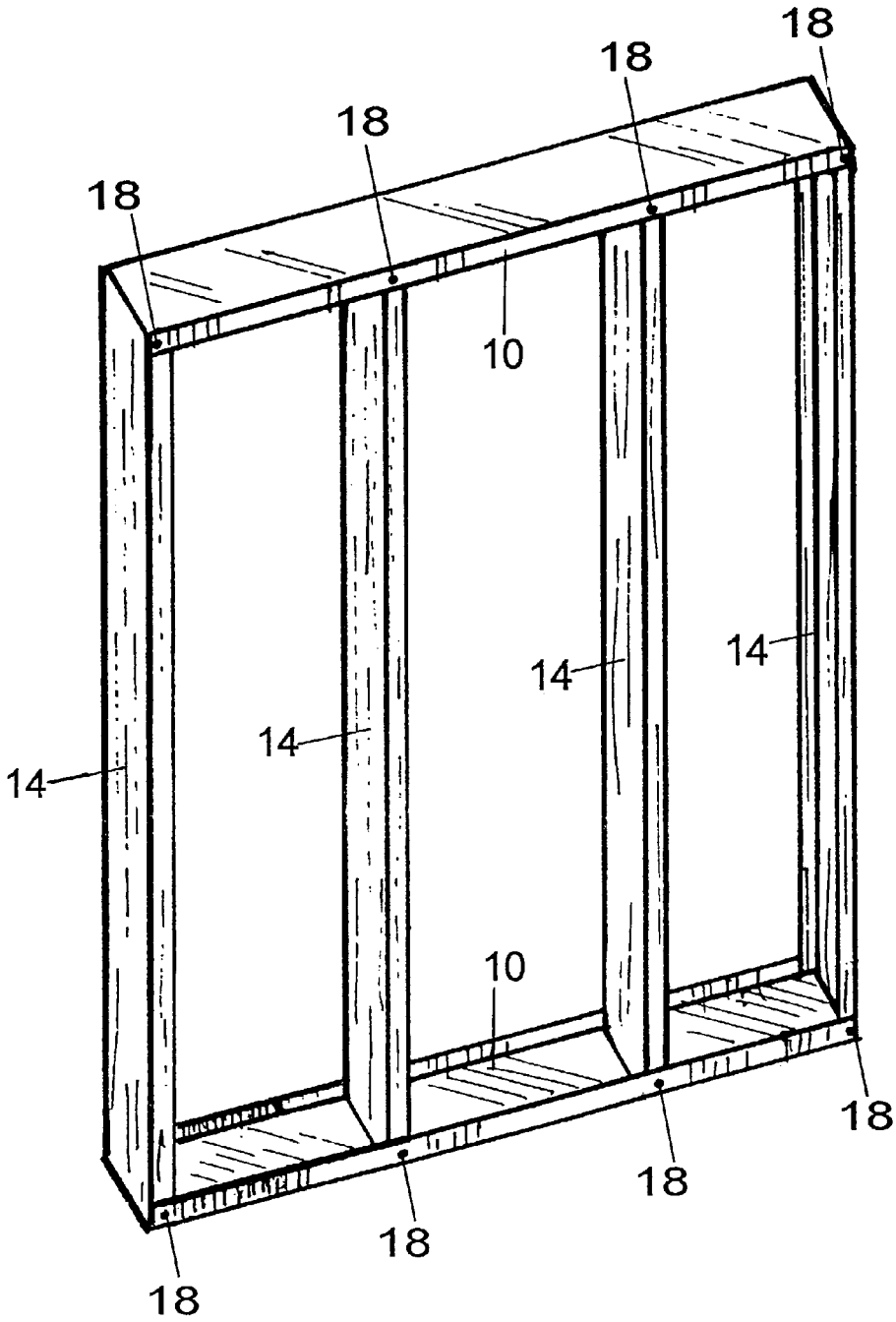
FIG. 2 shows collapsible wall frame, expanded and engaged.
Figure 4:
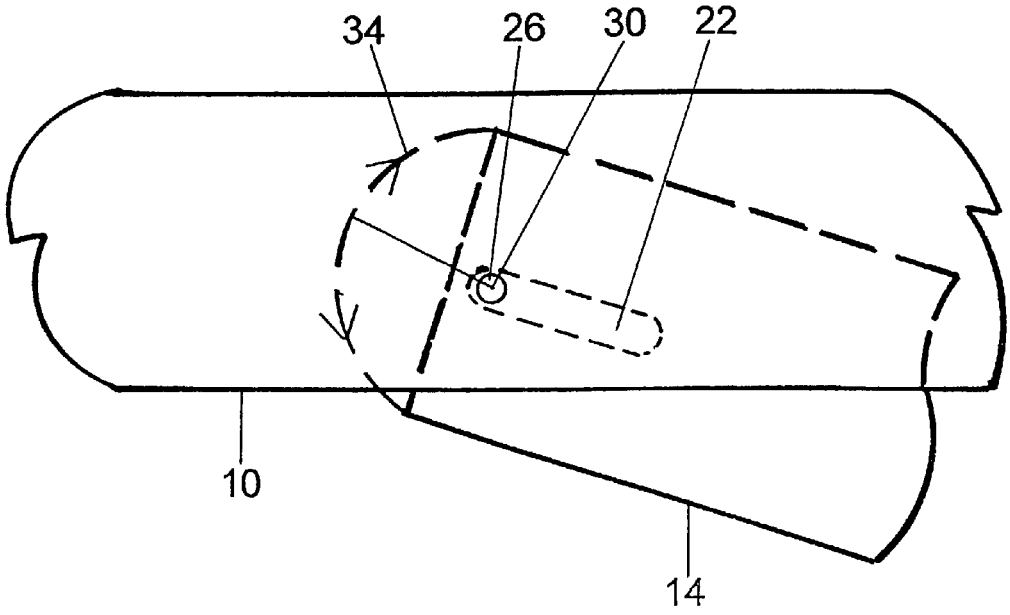
FIG. 4 illustrates stud, 14, in pivot around hole, 26, in track, 10. Pivot point, 30, is at top of elongated perforation, 22, allowing arc, 34, to clear interior of track channel, 42.

The frames are prefabricated off-site in accordance with a building plan and transported to the site in collapsed mode (FIG. 1-B). The dimensions of the prefabricated frame are determined by plan requirements.

Once unloaded at the building site, a wall frame, for example, can be expanded by drawing tracks (horizontal members), 10, away from each other. As tracks, 10, are drawn away, connector, 18, slides within elongated perforation, 22. Sufficient space occurs which allows studs, 14, to pivot within track channel, 42. Frame can then be expanded. As frame is expanded, studs slide along connectors, 18. When wall is fully expanded, tracks can be pressed toward each other and studs will lodge flush and firmly against the interior of the track channel 42, thus engaging the frame.

The engaged frame, be it a wall, floor or roof frame, can then be stabilized, plumbed and braced as dictated by the building plan.

Window, door, or other openings may be included in the prefabricated frame or may be installed onsite. If changes are required after the prefabricated frames arrive at the building site, readily available components compatible with those used in the prefabrication process can be installed onsite. It is not necessary for these site-installed components to be collapsible, since the frames already have been permanently installed at the building site.

CONCLUSION, RAMIFICATIONS, AND SCOPE

Rapid construction of steel framed structures, residential and commercial, offers substantial social and financial advantages. The collapsible, metal, load bearing and non-load bearing framing system set forth in this invention offers:

- Financial advantage due to shortened construction time.
- The elongated perforation is adaptable to pieces of metal of various sizes and shapes. Cost is reduced by using material readily available on the market to fabricate frames. Expensive specially formed metal is not necessary.
- This framing system can be employed for all, or part, of a structure without compromising that which uses conventional framing methods.
- This framing system can be used for load bearing and non-load bearing wall, floor and roof frames.
- Transportation cost is lessened by shipping prefabricated frames collapsed.
- The collapsed frame is quick and easy to erect.
- Wall, floor or roof frames can be erected by a worker with only rudimentary construction skills.
- This system accommodates onsite changes. Members in a prefabricated frame can be removed quickly merely by withdrawing connectors. With connectors removed, members will disconnect from tracks and can be used elsewhere and are interchangeable with non-perforated members.
- This system contributes to on-the-job safety by minimizing several hazardous tasks onsite, such as cutting members to size with power tools.

Although the description above contains much specificity, this should not be construed as limiting the scope of the invention but merely providing illustrations of some of the presently preferred applications of this invention.

What I claim as my invention is:

1. A load bearing frame comprising:

a stud having a longitudinal axis, a top with a horizontal dimension, and an elongated perforation, the elongated perforation having an uppermost point and a lowermost point, the elongated perforation elongated along the longitudinal axis and the elongated perforation disposed through the stud at an axis perpendicular to the longitudinal axis, wherein the top of the stud is separated from the uppermost point of the elongated perforation by a predefined distance;

a track having a pivot point and a channel, wherein the stud is inserted at least partially within the channel;

a connector for attaching the stud to the track through at least a portion of the elongated perforation and through the pivot point;

an arc defined at least in part by the horizontal dimension of the top of the stud and the predefined distance, the arc representing a pivoting of the stud within the channel around the pivot point when the connector is at the uppermost point of the elongated perforation, allowing the stud and the track to collapse to a compact and intact configuration; and wherein the top of the stud fits non-pivotally against an interior of the track when the connector is at the lowermost point of the elongated perforation and transfers a load placed on a top of the track to the top of the stud.

2. The load bearing frame of claim 1, wherein the top of the stud fits non-pivotally against the interior of the track when the connector is at the lowermost point of the elongated perforation and transfers at least a portion of the load placed on the top of the track to the connector.

3. The load bearing frame of claim 1, wherein the top of the stud fits non-pivotally against the interior of the track when the connector is at the lowermost point of the elongated perforation and transfers at least a portion of the load placed on the top of the track to the lowermost point of the elongated perforation.

4. The load bearing frame of claim 1, wherein the top of the stud fits non-pivotally against the interior of the track when the connector is at the lowermost point of the elongated perforation and transfers at least a portion of the load placed on the top of the track to the connector and the lowermost point of the elongated perforation.

5. The load bearing frame of claim 1, wherein the top of the stud fits non-pivotally against the interior of the track when the connector is at the lowermost point of the elongated perforation and forms part of a permanent structure.

6. The load bearing frame of claim 1, wherein the elongated perforation is slightly larger than a diameter of the connector.

7. The load bearing frame of claim 1, further comprising an opening for a door located at least partially between the track and the stud.

8. The load bearing frame of claim 1, further comprising an opening for a window located at least partially between the track and the stud.

9. The load bearing frame of claim 1, further comprising an opening for a pipe located at least partially between the track and the stud.

10. The load bearing frame of claim 1, wherein the stud is metal.

11. The load bearing frame of claim 1, wherein the track is metal.

12. A load bearing frame comprising:

a stud having a longitudinal axis, a top with a horizontal dimension, and an elongated perforation, the elongated perforation having an uppermost point and a lowermost point, the elongated perforation elongated along the longitudinal axis and the elongated perforation disposed through the stud at an axis perpendicular to the longitudinal axis, wherein the top of the stud is separated from the uppermost point of the elongated perforation by a predefined distance;

a first track having a first pivot point and a first channel, wherein the top of the stud is inserted at least partially within the first channel;

a connector for attaching the stud to the first track through at least a portion of the elongated perforation and through the first pivot point;

an arc defined at least in part by the horizontal dimension of the top of the stud and the predefined distance, the arc representing a pivoting of the stud within the first channel around the first pivot point when the connector is at the uppermost point of the elongated perforation, allowing the stud and the first track to collapse to a compact and intact configuration;

wherein the top of the stud fits non-pivotally against an interior of the first track and transfers a load placed on a top of the first track to the top of the stud; and a second track having a second pivot point and a second channel, wherein a bottom of the stud is inserted at least partially within the second channel.

13. The load bearing frame of claim 12, further comprising an opening for a pipe located at least partially between the first track, the second track, and the stud.

* * * * *